United States Patent [19]

DeSantis et al.

[11] 4,389,593

[45] Jun. 21, 1983

[54] ACTIVE DIELECTRIC WAVEGUIDE AMPLIFIER OR OSCILLATOR USING A HIGH DENSITY CHARGED PARTICLE BEAM

[75] Inventors: Charles M. DeSantis, Neptune; Louis J. Jasper, Jr., Ocean, both of N.J.

[73] Assignee: The United States of America as represented by the Secretary of the Army, Washington, D.C.

[21] Appl. No.: 255,121

[22] Filed: Apr. 17, 1981

[51] Int. Cl.[3] ..... H01J 25/00

[52] U.S. Cl. ..... 315/4; 315/3; 315/5; 331/104

[58] Field of Search ..... 315/3, 4, 5, 5.34, 5.35; 331/104, 79

[56] References Cited

U.S. PATENT DOCUMENTS

| | | | |
|---|---|---|---|
| 2,828,439 | 3/1958 | Fletcher | 315/5.35 |
| 2,959,706 | 11/1960 | Cutler | 315/3 |
| 3,102,211 | 8/1963 | Sturrock | 315/5.34 X |
| 3,183,399 | 5/1965 | Pantell | 315/4 |
| 3,259,786 | 7/1966 | Phillips | 315/3 |
| 3,270,241 | 8/1966 | Vural | 315/3 |
| 3,463,959 | 8/1969 | Jory et al. | 315/5 |

*Primary Examiner*—Saxfield Chatman, Jr.

*Attorney, Agent, or Firm*—Robert P. Gibson; Jeremiah G. Murray; Michael C. Sachs

[57] ABSTRACT

A circuitless particle beam device for relatively high frequency amplifier or oscillator applications that eliminates the requirement for an internal RF slow wave structure. A circularly polarized RF energy wave propagates on a relatively high density particle beam within an oversized waveguide and interacts with the beam which exhibits a relatively high dielectric constant. The high density beam acts as an active dielectric waveguide serving the dual purpose of a slow wave circuit and amplification source, and accordingly guides and amplifies the RF energy when a condition of beam and wave synchronism is met.

16 Claims, 6 Drawing Figures

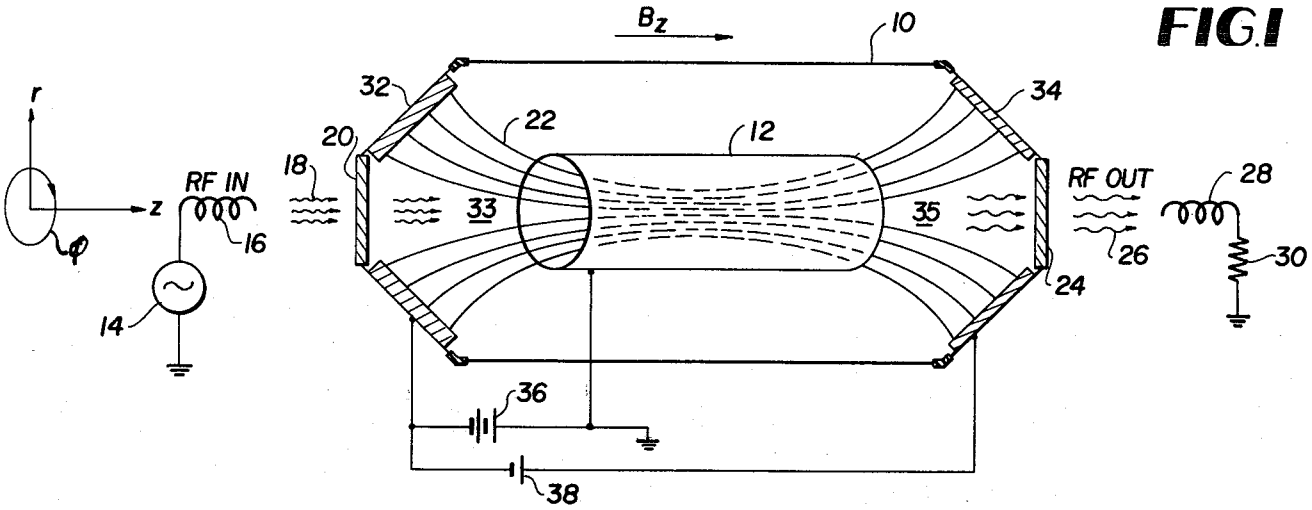
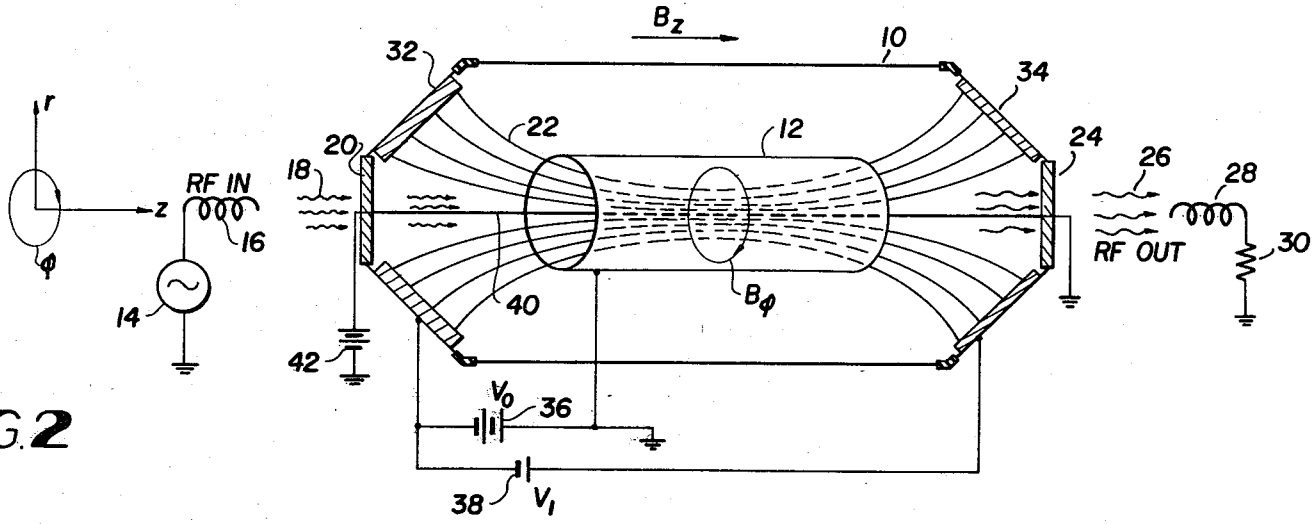
FIG.2

ACTIVE DIELECTRIC WAVEGUIDE AMPLIFIER OR OSCILLATOR USING A HIGH DENSITY CHARGED PARTICLE BEAM

The invention described herein may be manufactured, used, and licensed by or for the Government for governmental purposes without the payment to us of any royalties thereon.

BACKGROUND OF THE INVENTION

1. Field of the Invention

This invention relates to high frequency energy devices operable at microwave, millimeter wave, infrared and optical frequencies wherein an interchange of energy takes place between a stream of charged particles and an electromagnetic wave in a waveguide, and more particularly to such devices wherein the electromagnetic wave extracts energy from an electron beam as it propagates on the beam within the waveguide.

2. Discussion of the Prior Art

Microwave amplifiers that utilize an electron beam to achieve amplification have essential parts that comprise these devices. That is, means of generating, directing, and collecting the electron beam are essential. Typically, an electron gun, magnetic or electrostatic focusing field, and a collector serve the above purposes. In conjunction with an electron beam is a means for translating i.e. propagating, an RF energy wave in the vicinity of the electron beam in order to obtain an interaction between beam and wave for the purpose of amplifying the RF energy in the wave. RF amplifiers such as traveling wave tubes (TWT), klystrons, and crossed field amplifiers (CFA) use various structures such as the helix, ring-bar, ring-loop, cavities, meander lines, vanes, etc. to translate or propagate the RF energy which velocity modulates, i.e. bunches, the electron beam in the vicinity of the RF wave field. The primary differences in these types of amplifiers are the strength and time duration of the RF fields for bunching the electron beam and spatial characteristics of the beam.

The construction of the traditional slow-wave high power microwave tube becomes increasingly difficult and more expensive with increasing frequency. Consequently, at mm wave frequencies, the devices are prohibitively expensive and the RF performance characteristics are degraded.

Another class of devices worthy of mentioning are the so-called space charge amplifiers that also depend on space charge bunching phenomena for their functioning. These devices include velocity-jump, space-jump and scalloped-beam amplifiers. What is characteristic about these types of apparatus is that they do not depend upon RF guiding structures, which makes them relatively simple to construct. Application of these devices have been limited, however, because of their focusing difficulties, higher order mode generation and low gain per unit length. Recent interest in the millimeter (mm) wave range of the electromagnetic spectrum has generated added interest in the space charge amplifiers based on new interaction mechanisms which show promise of producing practical devices.

In the field of gyrotron technology, devices employing relativistic interaction mechanisms have obtained impressive RF output power and efficiency. However, the very high voltages and high magnetic fields which require superconductive solenoids are not attractive features for light weight mm wave amplifiers for airborne and tactical applications.

Known prior art patents and publications of interest include: U.S. Pat. No. 3,129,356 issued to R. M. Phillips for a "Fast Electromagnetic Wave And Undulating Electron Beam Interaction Structure"; U.S. Pat. No. 3,118,083 issued to E. A. Ash for a "Cyclotron Wave Harmonic Generator"; an article in *IEEE Transactions on Microwave Theory and Techniques,* Vol. MTT-25, No. 6 June, 1977, pages 561–563 by J. E. Walsh, et al. entitled "Relativistic Electron-Beam-Generated Coherent Submillimeter Wavelength Cerenkov Radiation"; an article in *Physics Today,* December, 1962, pages 38–42, by N. Marcuvitz entitled "Propagation of Waves in Plasma"; a survey article from Varian Associated, Inc., pages 234–237, by H. R. Jory et al. entitled "Gyrotrons for High Power Millimeter Wave Generation"; and a news note in *Industrial Research,* July, 1976, p. 14, on "Lasers-electron Beam Amplifies Laser".

It is, therefore, an object of this invention to provide an improvement in relatively high frequency amplifier type devices.

It is another object of the invention to provide a device for microwave, millimeter wave, infrared and optical frequency applications that is relatively simple and inexpensive to manufacture, yet is free from circuit and power limitations imposed by known slow-wave devices and free from high voltage and high magnetic field limitations imposed by known fast wave devices.

SUMMARY

These and other objects are accomplished by means of a circuitless charged particle beam or plasma amplifier in which an RF energy wave is launched onto a high density charged particle beam having a relatively high dielectric constant. The beam and wave propagate together through an oversized waveguide. The beam accordingly acts as an active dielectric waveguide serving not only as a slow-wave circuit for the RF energy wave but also as an amplification source to guide and amplify the RF energy wave when a condition of beam and wave synchronism is met, that is, when the drift velocity of the beam and the phase velocity of the RF energy wave are substantially the same.

BRIEF DESCRIPTION OF THE DRAWINGS

FIG. 1 is a cross sectional view schematically illustrative of the preferred embodiment of the subject invention;

FIG. 2 is a cross sectional view schematically illustrative of an alternative embodiment of the subject invention;

DESCRIPTION OF THE PREFERRED EMBODIMENTS

Figure 3:
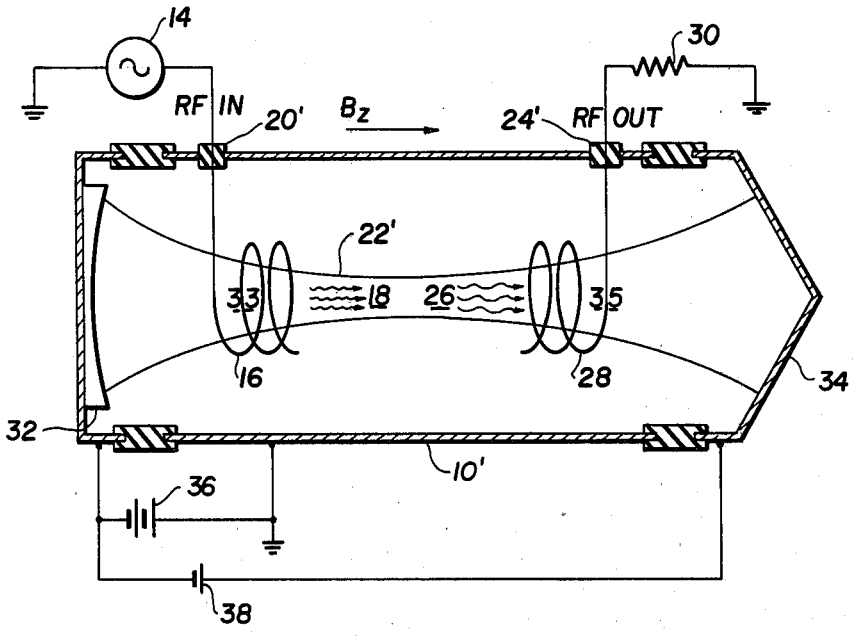
FIG. 3 is a cross sectional view schematically illustrative of another alternative embodiment of the subject invention.

Referring now to the drawings, the invention will now be described with reference to three embodiments thereof which are shown in FIGS. 1, 2 and 3. Referring first to FIG. 1, shown schematically is an elongated generally cylindrical vacuum type housing 10 enveloping a cylindrical metal waveguide 12 which has a smooth inner wall and which is oversized with respect to a predetermined RF operating frequency. Typically the diameter of the waveguide 12 is of the order of five times the wavelength of an RF energy wave to be amplified therein. Although not shown, the metal waveguide 12 is supported inside the vacuum housing 10 but could be an integral part of the vacuum housing when desired. Reference numeral 14 denotes an RF signal generator coupled to means 16 for launching an RF energy wave 18 preferably in the microwave and/or millimeter wave region of the electromagnetic spectrum; however, when desirable the range can be extended to include infrared and optical frequencies. The means 16 is preferably a directive, circularly polarized antenna. Accordingly a circularly polarized wave 18 emitted from the antenna 16 is introduced through an input window 20 into the housing 10 and propagates on a relatively high density charged particle or plasma beam 22 through the waveguide 12 and passes out of the vacuum housing 10 through an output window 24 where it emerges as an RF output beam 26 which impinges on a circularly polarized receiving antenna 28. The antenna 28 is coupled to a load 30 which comprises a suitable utilization circuit.

The beam 22, which preferably comprises a hollow electron beam, is generated by a thermionic cathode 32 and collected by a collector electrode 34 located at opposite ends of the housing 10. The wave 18, moreover, is made to converge on a region 33 of increasing particle density which provides a gradual transition region whereby the wave 18 is made to propagate on the beam 22. At the other end of the beam 22 there is a region 35 of decreasing particle density where the wave 18 leaves the beam and travels toward the output window 24.

Within the waveguide 12, the beam is made to have a current density in the order of 100 amperes per square centimeter (100 A/cm$^2$) or greater. When confined and focused by an axial magnetic field $B_z$, the high current density beam 22 is caused to rotate at the cyclotron frequency which, for an elliptically or circularly polarized wave 18 appears to have a high relative dielectric constant ($\epsilon_r >> 1$). The beam then acts as a dielectric waveguide which operates to slow down wave 18. Upon a synchronous condition being met between the RF energy wave 18 and the electron beam 22, amplification of the RF energy in the wave 18 results whereupon the beam 22 acts as an active dielectric waveguide. DC voltage sources 36 and 38 are adapted to apply operational voltages $V_0$ and $V_1$ across the electrodes 32 and 34 to control the drift velocity of the beam 22 such that it substantially coincides with the phase velocity of the slowed down wave 18 at which time a condition of synchronism exists.

As to the embodiment shown in FIG. 2, an axial wire 40 is additionally located between the windows 20 and 24 and connected to a DC voltage source 42 to provide a transverse magnetic field component $B_\phi$ in the angular direction $\phi$ of a cylindrical coordinate system r, $\phi$, z inside the housing 10. In all other respects, the embodiment of FIG. 2 is like the embodiment of FIG. 1.

The embodiment shown in FIG. 3 employs a solid electron beam 22' and coaxial RF windows 20' and 24' to allow antennae 16 and 28 to be housed within a metal walled vacuum housing 10' which also acts as the oversized waveguide 12 (FIG. 1). In all other respects, the embodiment of FIG. 3 is like the embodiment of FIG. 1.

As to the theory of operation, in plasma physics, there arises a well known expression for the effective dielectric constant, $\epsilon_r$, of a plasma consisting of particles with the same charge e.g., electrons or ions, which is:

$$\epsilon_r = 1 - \frac{\omega_p^2}{\omega^2} \tag{1}$$

where $\omega$ is the operating frequency (2 $\pi$f), $\omega_p$ approximates the plasma frequency which is equal to $(\rho_o\eta/\epsilon_o)$, $\rho_o$ is the charge density; $\eta$ is the charge to mass ratio $$\left(\frac{e}{m}\right)$$

and $\epsilon_o$ is the dielectric constant in a vacuum.

When a plasma such as the electron beam 22 is made to drift while confined in a static magnetic field of flux density $B_O$ it can be shown from Maxwell's equation and the Lorentz equation of motion that under certain conditions the effective dielectric constant $\epsilon_r$ for an elliptically or circularly polarized, transverse electromagnetic wave becomes:

$$\epsilon_r = 1 - \frac{(\omega_{p/\omega})^2}{1 \pm \omega_{c/\omega}} \tag{2}$$

where $\omega_c$ is the cyclotron frequency and where $\omega_c = \eta B_O$. Thus the effective dielectric constant is a function of magnetic flux density. In general, however, the effective dielectric constant $\epsilon_r$ of the drifting plasma in a longitudinal magnetic field $B_z$ (FIG. 1) is not isotropic. Furthermore, because of the relative motions between the electrons and the electromagnetic wave in the beam, it is reasonable to expect that, in the moving frame of reference of the electron, the effective operating frequency will be shifted due to the Doppler effect. Thus, the more generalized expression for the relative dielectric constant $\epsilon_r$ which is readily a diagonal tensor quantity that can be stated by a diagonal matrix as:

$$\epsilon_r = \begin{pmatrix} 1 - \frac{\omega_p^2}{\omega\omega_D}\left(\frac{\omega_D}{\omega_D \pm \omega_c}\right) & o & o \\ o & 1 - \frac{\omega_p^2}{\omega\omega_D}\left(\frac{\omega_D}{\omega_D \pm \omega_c}\right) & o \\ o & o & 1 - \frac{\omega_p^2}{\omega\omega_D} \end{pmatrix} \tag{3}$$

where $\omega_D$ is the Doppler shifted frequency, and $$\omega_D = \omega\left(1 - \frac{\mu_O}{v}\right)$$

where $u_O$ is the drift velocity of the beam 22 and v is the phase velocity of the wave 18 in the beam.

Under more generalized conditions, the beam can be characterized as having a nearly isotropic dielectric constant. As a further consequence of the theory, the relative permeability, $\mu_r$, becomes equal in magnitude to the relative permittivity (dielectric constant) $\epsilon_r$, that is $\epsilon_r = \mu_r$.

Accordingly by adjusting the charge density $\rho_O$ of the beam and the strength of the magnetic field $B_z$, a well formed cylindrical beam can be generated with a relatively large dielectric constant $\epsilon_r$, $\epsilon_r >> 1$. This beam will support propagation of an RF energy wave 18 at a reduced phase velocity v, which may have a value as small as $c/\sqrt{\epsilon_r \mu_r} = c/\epsilon_r$, where c is the velocity of light in vacuum. If circularly or elliptically polarized RF energy is introduced onto the beam 22 and the beam has a drift velocity of $u_O$, interaction will occur when the beam velocity $u_O$ substantially equals the phase velocity v of the RF wave 18. In fact a relatively strong interaction will occur when the beam velocity $u_O$ is slightly greater than the wave velocity v.

Recalling that the Doppler shift (reduction) can be significant as v approaches $u_O$, and that the cyclotron frequency $\omega_c$ must be near the operating frequency in the isotropic theory just described, it is apparent that a significant reduction in the required magnetic field density is realized, especially in the millimeter wave region. This fact leads to the realization of relatively compact, simpler less costly devices.

This interaction between the beam 22 and wave 18 of the RF energy can further be understood if one solves Maxwell's equations for wave propagation in a dense electron beam of circular cross section in an axial magnetic field which results in a characteristic (root) equation which can be expressed as:

$$\frac{\beta I_1(\gamma_r r_o)}{\gamma_r I_o(\gamma_r r_o)} = \frac{\beta_o K_1(k_o r_o)}{k_o K_o(k_o r_o)} \quad (4)$$

where $\beta_o$ is the free space propagation constant; $\beta$ is the propagation constant of a plane wave in the dielectric medium e.g. electron beam; $\gamma_r$ and $k_o$ are complex radial propagation constants inside and outside of the beam of a radius $r_o$; and $I_n$ and $K_n$ are Bessel functions with complex arguments.

Roots of equation (4) can be found in the following way:

$$\text{Let } \gamma_r r_o = \rho\, e^{j\phi} \text{ and} \quad (5)$$

$$k_o r_o = \xi\, e^{j\theta} \quad (6)$$

and then separate equation (4) into real and imaginary parts which results in:

$$\frac{\beta_o}{\beta} = Re\left[\frac{k_o I_1(\gamma_r r_o)\, K_o(k_o r_o)}{\gamma_r I_o(\gamma_r r_o)\, K_1(k_o r_o)}\right] \text{ and} \quad (7)$$

$$O = I_M\left[\frac{k_o I_1(\gamma_r r_o)\, K_o(k_o r_o)}{\gamma_r I_o(\gamma_r r_o)\, K_1(k_o r_o)}\right] \quad (8)$$

By numerically assigning values to any three of the four parameters $\rho$, $\phi$, $\xi$, $\theta$ in equations (7) and (8), and solving for the fourth or remaining parameter in order to satisfy equations (7) and (8), the axial propagation constant $\gamma_z$ can be obtained as a function of frequency from the following propagation constant equations:

$$\gamma_r^2 = \gamma_z^2 - \beta^2 \quad (9)$$

and $$k_o^2 = \gamma_z^2 - \beta_o^2 \quad (10)$$

If $\gamma_z$ is defined as $\gamma_z = \kappa + j\alpha$, one can expand equations (9) and (10) into real imaginary parts and arrive at expressions for the growth factor $\alpha$ and the axial propagation factor $\kappa$, such that $$\alpha = \frac{\rho^2 \sin(2\phi)}{2 r_o^2 \kappa} \text{ and } \kappa = \pm \left[\frac{(\beta^2 + \rho^2/r_o^2 \cos(2\phi) \pm \sqrt{\beta^4 + \rho^4/r_o^4 + 2\beta^2\rho^2/r_o^2 \cos(2\phi)}}{2}\right]^{\frac{1}{2}}$$

Figure 4:
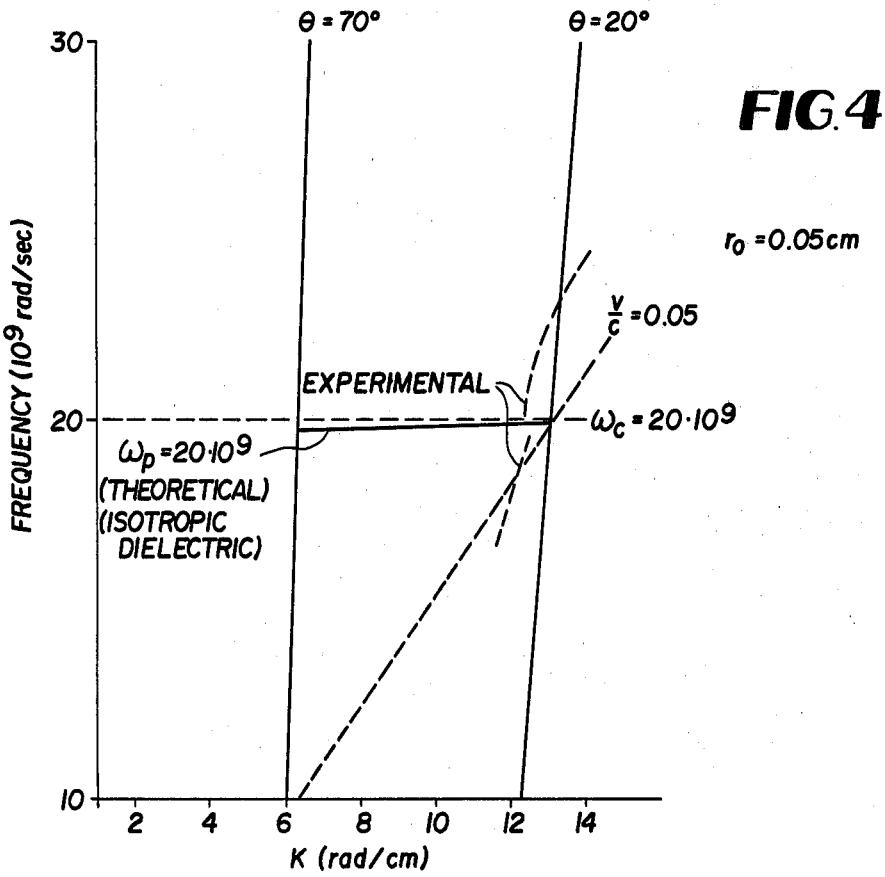
FIGS. 4, 5 and 6 are a set of graphs helpful in understanding the principles of operation of the subject invention.
Figure 6:
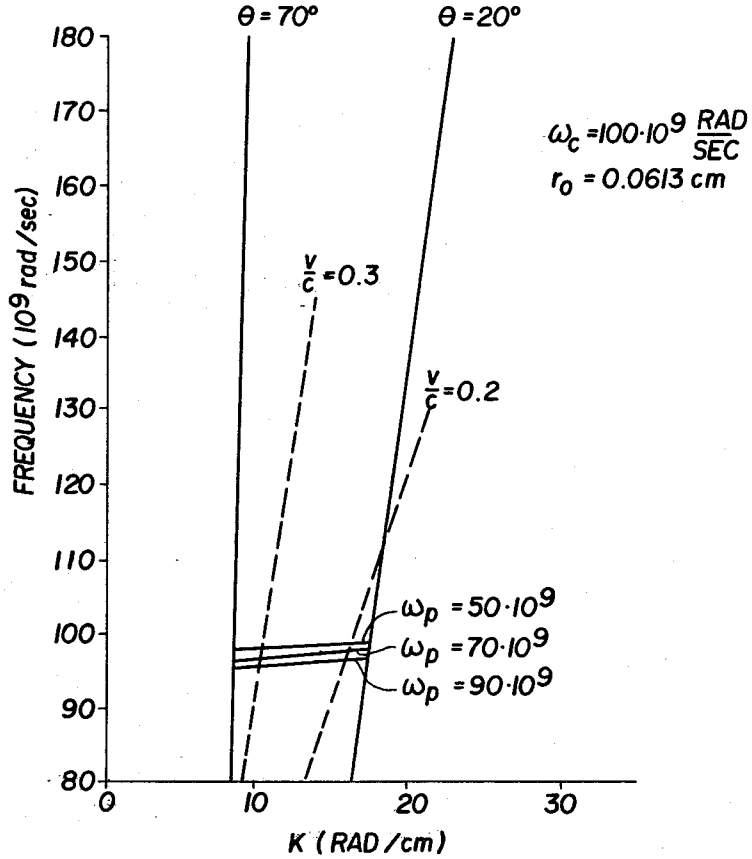
Figure 5:
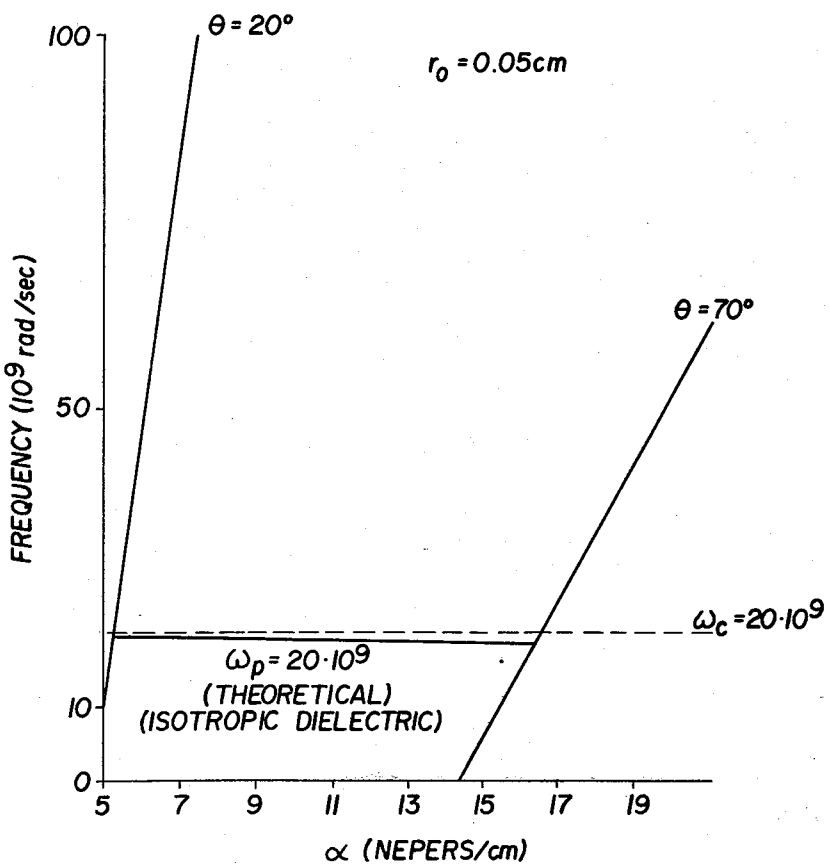

In accordance with the foregoing, complex roots have been found indicating both propagation and gain for the conditions set forth. The graphical illustrations of FIGS. 4, 5 and 6, moreover, confirm this. Referring to these figures the plots of FIGS. 4 and 5 illustrate theoretical results of the isotropic dielectric theory for the axial propagation $\kappa$ and growth $\alpha$ factors as a function of frequency $\omega$. In particular, FIGS. 4 and 5 show the region between $\theta = 70°$ and $\theta = 20°$ over which valid solutions exist for equations (7) and (8). In addition, FIG. 4 includes an illustration of data acquired from an experimental device indicating general agreement with the theoretical considerations set forth above, while FIG. 6 is intended to show that the theoretical solutions extend into the millimeter wave region and still yield devices having reasonable physical dimensions and electrical operating parameters.

It should be understood that the subject invention has been shown and described with respect to a simplified form thereof and accordingly certain details, such as the magnetic focusing structure and means to cool the housing are omitted so as not to obscure the essential elements of the invention. Also, the invention is not limited to the specific arrangements as shown since when desirable alternate embodiments might be resorted to such as one where the beam is formed non-symmetrically about the central axis where a rectangular or other cross sectional geometry type of waveguide is utilized, or where the spent beam is collected in a non-symmetrical manner. Accordingly, all alterations, modifications, and changes coming within the spirit of the invention as set forth herein are meant to be included.

What is claimed is:

1. An RF slow wave particle beam amplifier device comprising:

an evacuated waveguide structure included within an envelope, said waveguide structure having an internal cross sectional dimension which exceeds five times the wavelength of a predetermined RF frequency of a wave propagated therethrough, including a coaxial RF input window and a coaxial RF output window for providing entry and exit of a wave to and from said envelope, the waveguide structure comprising a hollow cylindrical, metal structure with a smooth inner wall;

thermionic cathode means for generating and projecting a relatively high density electron particle beam providing an effective dielectric constant through said waveguide structure to provide an active, dielectric medium;

means for providing an axial magnetic field through said waveguide structure for focusing, confining and causing rotation of the particles of said beam in said waveguide structure at a cyclotron frequency $w_c$ which is expressed by the equation:

$$w_c = hB_O$$

where h is the charge to mass ratio of said beam and $B_O$ is the magnetic flux density, including means for adjusting $B_O$ and h for shaping the beam geometry;

means for generating and launching an elliptically polarized RF wave of predetermined millimeter waveband frequency onto said high density beam whereupon said active dielectric medium operates as a waveguide to guide said RF wave and transfer energy to said wave as the RF wave propagates on said beam when the drift velocity of said beam is substantially the same as or greater than the phase velocity of said RF wave; wherein the effective relative dielectric constant $e_r$ of said beam is expressed in the form of a diagonal matrix as:

$$e_r = \begin{pmatrix} 1 - \frac{w_p^2}{ww_D}\left(\frac{W_D}{W_D \pm W_c}\right) & o & o \\ o & 1 - \frac{w_p^2}{ww_D}\left(\frac{W_D}{W_D \pm W_c}\right) & o \\ o & o & 1 - \frac{w_p^2}{ww_D} \end{pmatrix}$$

where $w_p$ is the beam frequency, $w_c$ is the cyclotron frequency, w is the frequency of the RF wave, and $W_D$ is the Doppler shifted frequency of the RF wave according to the expression:

$$W_D = W\left(1 - \frac{u_o}{v}\right)$$

where $u_o$ is the drift velocity of the beam and v is the phase velocity of the wave in the beam;

means for controlling the drift velocity of said particle beam in said waveguide structure by means of d.c. fed electrode;

collector means for collecting said beam downstream at opposite end from said generating and projecting means; and means for receiving said RF wave emerging from said beam following propagation thereon.

2. The device as defined by claim 1 wherein said means for generating and projecting said beam provides at least one region which varies in density along its length.

3. The device as defined by claim 2 wherein said region of varying density comprises a region of increasing density where said RF wave is launched onto said high density beam.

4. The device as defined by claim 3 and additionally including a region of varying density going from a region of relatively high density to a region of less density where said RF wave emerges from said beam.

5. The device as defined by claim 1 and additionally including means for providing another magnetic field through said waveguide structure and comprising an energized electrical conductor axially located with respect to said waveguide structure.

6. The device as defined by claim 1 wherein said high density beam is located substantially along the central longitudinal axis of said hollow waveguide structure.

7. The device as defined by claim 1 wherein said beam is generally cylindrical in cross section.

8. The device as defined by claim 7 wherein said generally cylindrical cross sectional beam comprises a hollow beam of electrons.

9. The device as defined by claim 7 wherein said generally cylindrical beam comprises a substantially solid beam of electrons.

10. The device as defined by claim 9 and wherein said waveguide structure also acts as an envelope for said device.

11. The device as defined by claim 10 wherein said means for launching and receiving said RF wave are located in said waveguide structure.

12. The device of claim 1 wherein the said predetermined wave frequency is in the infrared frequency band.

13. The device of claim 1 wherein the said predetermined wave frequency is in the optical frequency band.

14. The device of claim 1 wherein said predetermined wave frequency is in the microwave frequency band.

15. The device of claim 1 wherein the said device is operated as a particle beam oscillator device.

16. An RF slow wave particle beam amplifier device comprising:

an evacuated waveguide structure included within an envelope said waveguide structure having internal cross sectional dimension which exceeds five times the wavelength of a predetermined RF frequency of a wave propagated therethrough, including a coaxial RF input window and a coaxial RF output window for providing entry and exit of said wave to and from said envelope, the waveguide structure comprising a hollow cylindrical, metal structure with a smooth inner wall;

thermionic cathode means for generating and projecting a relatively high density electron particle beam providing an effective dielectric constant through said waveguide structure to provide an active, dielectric medium;

means for providing an axial magnetic field through said waveguide structure for focusing, confining and causing rotation of the particles of said beam in said waveguide structure at a cyclotron frequency $w_c$ which is expressed by the equation:

$$w_c = hB_O$$

where h is the charge to mass ratio of said beam and $B_O$ is the magnetic flux density, including means for adjusting $B_O$ and h for shaping the beam geometry;

means for generating and launching an elliptically polarized RF wave of predetermined millimeter wave band frequency onto said high density beam whereupon said active dielectric medium operates as a waveguide to guide said RF wave and transfer energy to said wave as the RF wave propagates on said beam, when the drift velocity of said beam is substantially the same as or greater than the phase velocity of said RF wave; wherein the effective relative dielectric constant $e_r$ of said beam is expressed by the equation:

$$e_r = 1 - \frac{(w_p/w)^2}{1 \pm w_c/w}$$

where $w_p$ is the beam frequency, $w_c$ is the cyclotron frequency and w is the frequency of the RF wave, wherein the effective, relative permeability $u_r$ of said beam is equal in magnitude to the relative permittivity or dielectric constant $e_r$, wherein said RF wave propagates with a phase velocity v which is bounded by the equation:

$$v > c/e_r$$

where c is the velocity of light in a vacuum, means for controlling the drift velocity of said particle beam in said waveguide structure by means of d.c. fed electrodes;

collector means for collecting said beam downstream at opposite end from said generating and projecting means; and means for receiving said RF wave emerging from said beam following propagation thereon.

* * * * *